US006550831B2

(12) United States Patent
Rizk

(10) Patent No.: US 6,550,831 B2
(45) Date of Patent: Apr. 22, 2003

(54) LOCK AND EMERGENCY RELEASE SYSTEM FOR POWER OPERATED DOORS

(75) Inventor: Magdy A. Rizk, Brossard (CA)

(73) Assignee: Tekdata Inc., Brossard (CA)

( * ) Notice: Subject to any disclaimer, the term of this patent is extended or adjusted under 35 U.S.C. 154(b) by 0 days.

(21) Appl. No.: 09/833,600

(22) Filed: Apr. 13, 2001

(65) Prior Publication Data

US 2002/0149210 A1 Oct. 17, 2002

(51) Int. Cl.[7] ..... E05B 3/00; E05B 65/10; E05C 1/12; E05C 1/06

(52) U.S. Cl. ..... 292/336.3; 292/92; 292/93; 292/DIG. 65; 292/DIG. 46; 292/171; 292/141; 49/141; 49/279

(58) Field of Search ..... 292/336.3, 92, 292/93, DIG. 65, DIG. 46, 137, 141, 171; 49/141, 279, 360

(56) References Cited

U.S. PATENT DOCUMENTS 3,830,017 A * 8/1974 Markham ..... 292/210
4,103,945 A * 8/1978 Turman ..... 292/100
4,290,368 A * 9/1981 Mazzini ..... 105/341
5,456,504 A * 10/1995 Brillant ..... 292/63
5,486,026 A * 1/1996 Borgardt ..... 292/71
5,511,832 A * 4/1996 Kunzel ..... 292/141
5,771,636 A * 6/1998 Mathis ..... 49/137
6,189,265 B1 * 2/2001 Fink ..... 49/118
6,216,391 B1 * 4/2001 Garrett, Jr. ..... 49/141

* cited by examiner

*Primary Examiner*—J. J. Swann
*Assistant Examiner*—Matthew E. Rodgers

(57) ABSTRACT

A lock and emergency release system for a door normally power operated by a door operator. The system comprises a lock displaceable between an idle position to a functional position in which opening of the door by the door operator is prevented. An emergency release handle is manually operable for simultaneously displacing the lock to its idle position and releasing the door from the door operator, thereby allowing the door to be manually opened.

8 Claims, 7 Drawing Sheets

LOCK AND EMERGENCY RELEASE SYSTEM FOR POWER OPERATED DOORS

BACKGROUND OF THE INVENTION

1. Field of the Invention

The present invention relates to power operated doors and, more particularly, to a lock and emergency release system operable to allow manual movement of such doors under emergency conditions.

2. Description of the Prior Art

Sometimes a power operated sliding door must be prevented from opening, because of a flaw in the door. This is normally done using a standard manual locking mechanism which has to be locked and unlocked using a key. In an emergency, the manual locking mechanism has first to be unlocked with the key and then an emergency release handle can be pulled to release the door from its associated door operator so as to allow the door to be subsequently manually displaced to an open position thereof. This system can be very dangerous in the case of an emergency because a key is required to open the door if the same has been previously locked to prevent operation thereof by the door operator. Furthermore, two operations are required to unlock the door, thereby increasing the time required to open the door.

Accordingly, there is a need for a new door emergency release system which is adapted to simultaneously unlock a power operated door and release the same from its associated door operator without the necessity of a key.

SUMMARY OF THE INVENTION

It is therefore an aim of the present invention to provide a new lock and emergency release system for a power operated door.

It is also an aim of the present invention to provide such a lock and emergency release system which is adapted to enable a normally power operated door to be manually moved to an open position even when the door has been previously locked against opening by the door operator.

It is a further aim of the present invention to provide a relatively simple and reliable lock and emergency release system.

Therefore, in accordance with the present invention, there is provided a lock and emergency release system for a door normally power operated by a door operator, the system comprising a lock displaceable between an idle position to a functional position in which the door operator is prevented from opening the door, at least one emergency release means manually operable for displacing said lock to said idle position thereof and releasing the door from said door operator, thereby allowing the door to be manually opened.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
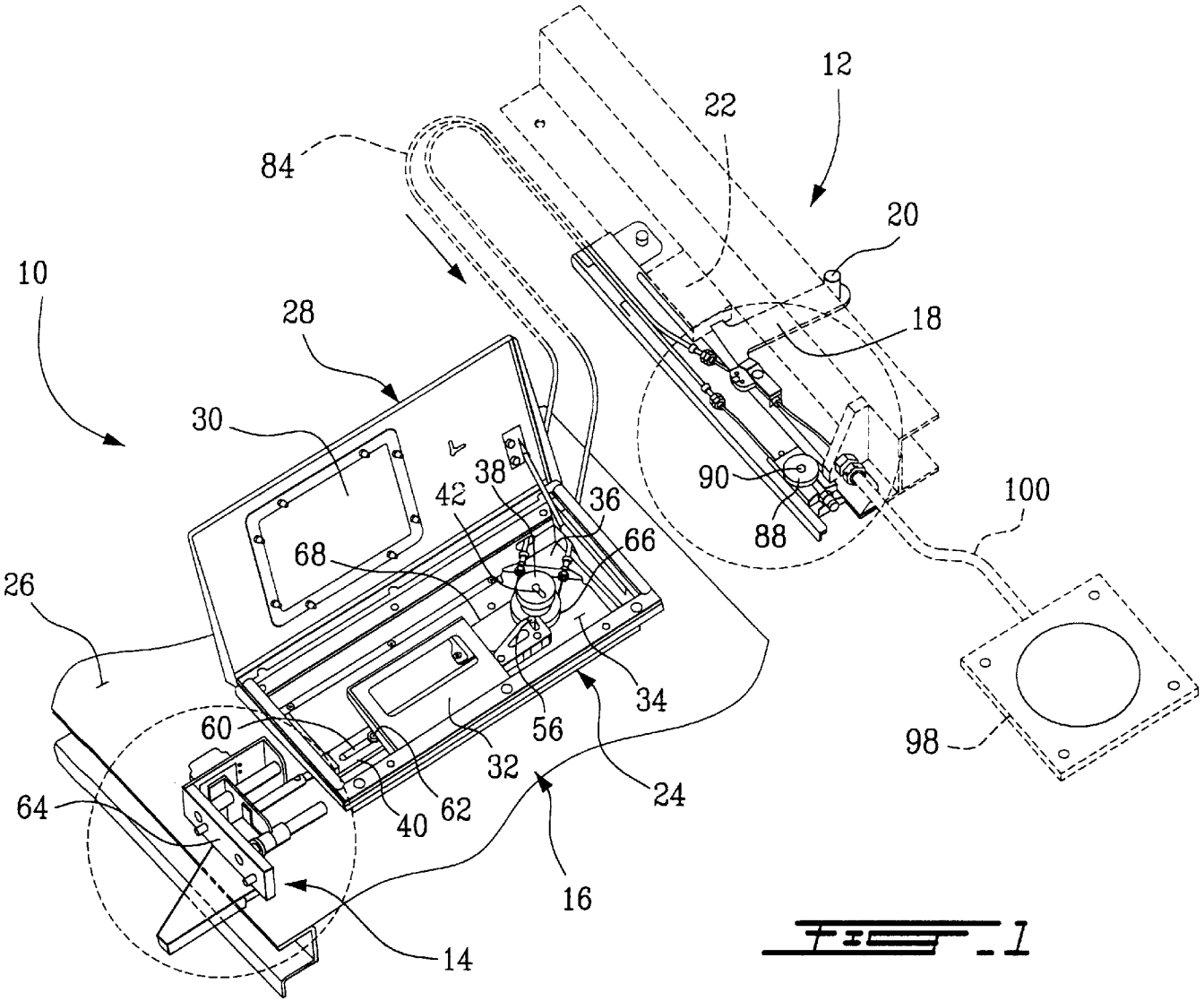
FIG. 1 is a perspective view of a lock and emergency release system in accordance with a first embodiment of the present invention.

FIG. 1 illustrates a lock and emergency release system 10 for use with a sliding door (not shown) normally displaced between closed and open positions by a conventional powered door operator partly shown at 12. The door operator 12 can be of the type typically used in a commuter train or the like for operating all the side doors of the train from a single remote location.

The lock and emergency release system 10 generally includes a lock mechanism 14 for physically preventing sliding movement of the door towards an open position, for instance, when the door has been damaged, and an emergency-release door mechanism 16, which is operable to simultaneously unlock the lock mechanism 14 and release the sliding door from the power operator door mechanism 12 so as to enable manual movement of the door under emergency conditions.

The door operator 12 includes a linkage (not shown) operatively connected to the door to effect movement thereof in response to the pivotal movement of an arm 18 pivotally mounted at 20. An electromagnetic unit 22 is provided to pivot the arm 18 between a lock position, as seen in FIG. 1, for closing the door and an unlocked position in which the arm 18 is pivoted away from the electro-magnetic unit 22 so as to cause the door to be opened by the linkage.

The lock mechanism 14 and the emergency-release door mechanism 16 are housed in a casing 24 adapted to be mounted to an interior wall 26 adjacent an opening defined therein for receiving the sliding door. A cover 28 is hinged to the casing 24 along a longitudinal edge thereof for selectively preventing and providing access to the interior of the casing 24. A lock (not shown) is provided to normally lock the cover 28 in the closed position thereof. A glass plate 30 is provided to cover an opening defined in the cover 28. The glass plate 30 is adapted to be broken to provide access to an emergency release handle 32, which is adapted to be operated to release the door, regardless of the respective conditions of the door operator 12 and the lock mechanism 14, as will be seen hereinafter.

An inclined mounting plate 34 is secured to a bottom wall 36 of the casing 24 for providing a mounting surface for the lock mechanism 14 and the emergency-release door mechanism 16.

Figure 2:
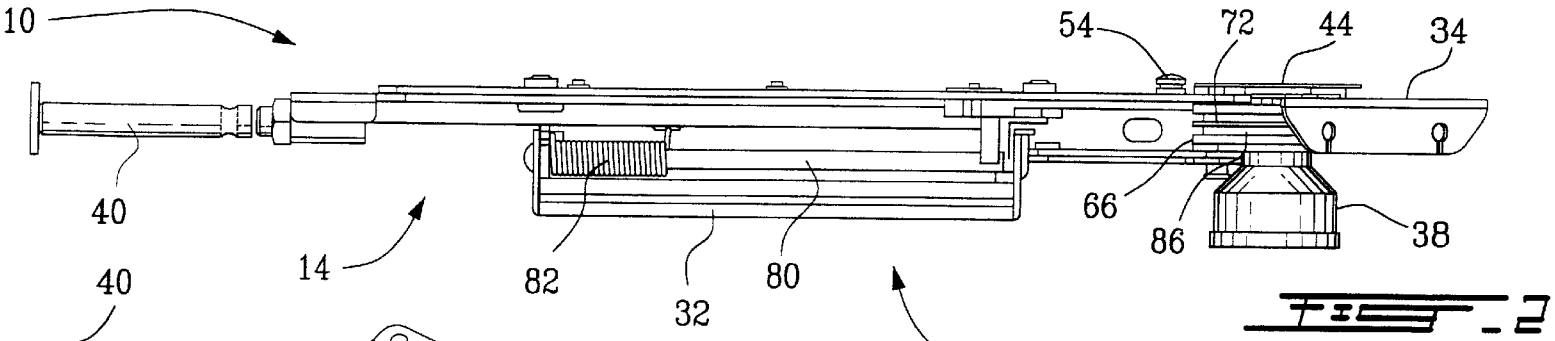
FIG. 2 is a top plan view of a main portion of the mechanism of the lock and emergency release system of FIG. 1.

The lock mechanism 14 includes a key drum 38 operable to reciprocate a latch bolt 40 between retracted and extended positions in a direction generally perpendicular to the plane of the sliding door. The drum 38 defines a key hole 42 for receiving a key, which is, in turn, adapted to be operated to rotate the drum 38 between locked and unlocked positions to effect displacement of the latch bolt 40. The drum 38 extends through the mounting plate 34 and is axially retained thereon by a drum retainer 44 secured at one end of the drum 38 on a back side of the mounting plate 34, as seen in FIG. 2.

Figure 7:
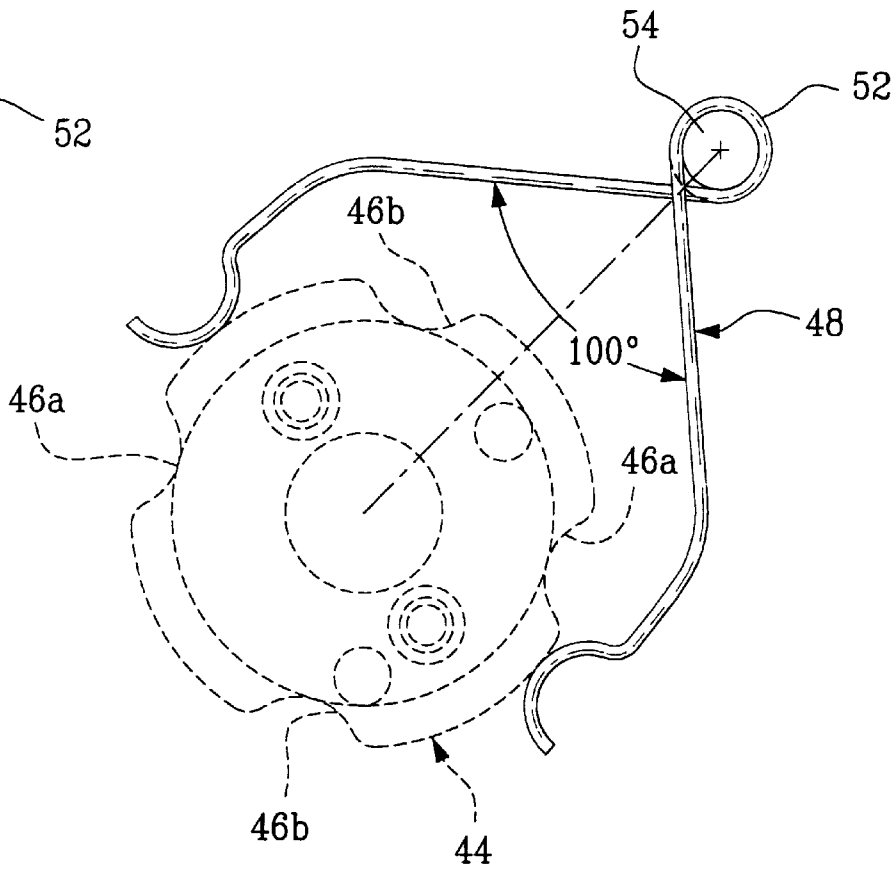
FIGS. 6 and 7 are top plan views of a drum spring mechanism used to releasably retain the key drum illustrated in FIG. 5 in locked and unlocked positions thereof.
Figure 6:
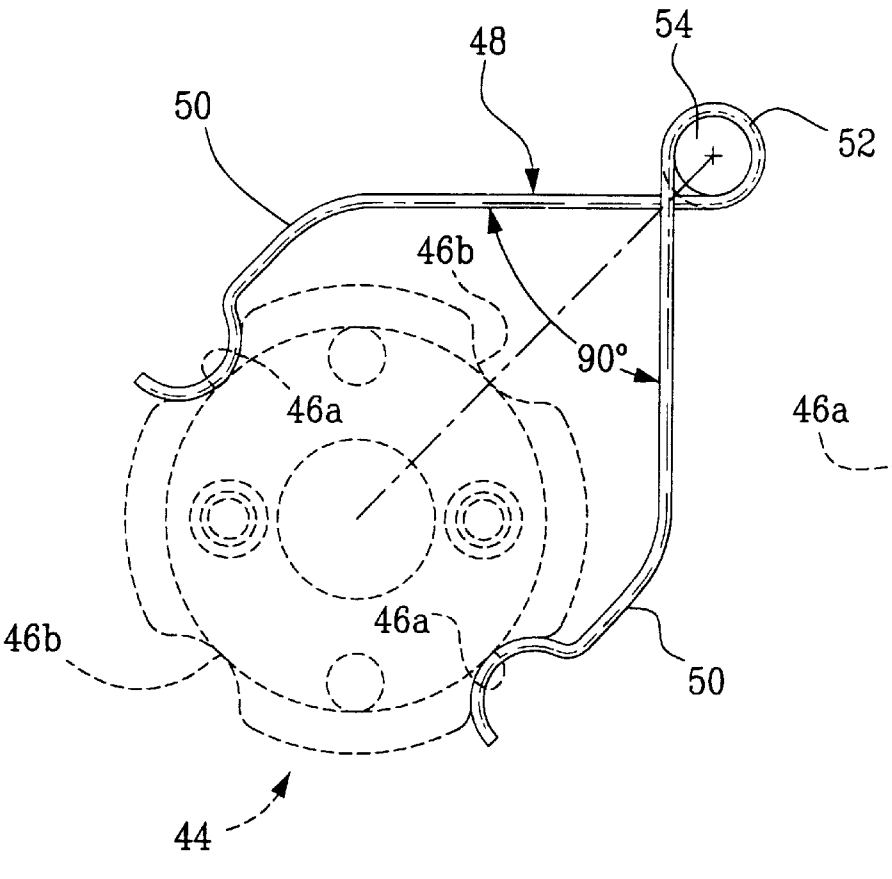

Referring to FIGS. 6 and 7, it can be seen that the drum retainer 44 has four peripheral semi-circular recesses 46 distributed along the circumference thereof. A one piece spring clip 48 having a pair of inwardly spring loaded arms 50 connected by an integral loop segment 52 extending about a fixed pin 54, is provided for engagement in diametrically opposed pairs of recesses 46 in order to releasably maintain the drum 38 in one of the unlocked and locked positions thereof. Upon rotation of the drum 38 from its locked position, as illustrated in FIG. 6, the spring-loaded arms 50 of the clip 48 will be pushed out of the recesses 46*a* against their respective biasing forces, as seen in FIG. 7, thereby allowing the drum 38 to be rotated to its unlocked position. Once the drum 38 will have been rotated to its unlocked position, the arms 50, because of their resilient nature, will fall in the second pair of diametrically opposed recesses 46*b*, thereby releasably retaining the drum 38 in its unlocked position. Accordingly, it is only required to overcome the biasing forces of the spring-loaded arms 50 to rotate the drum 38 between the unlocked and locked positions.

Figure 3:
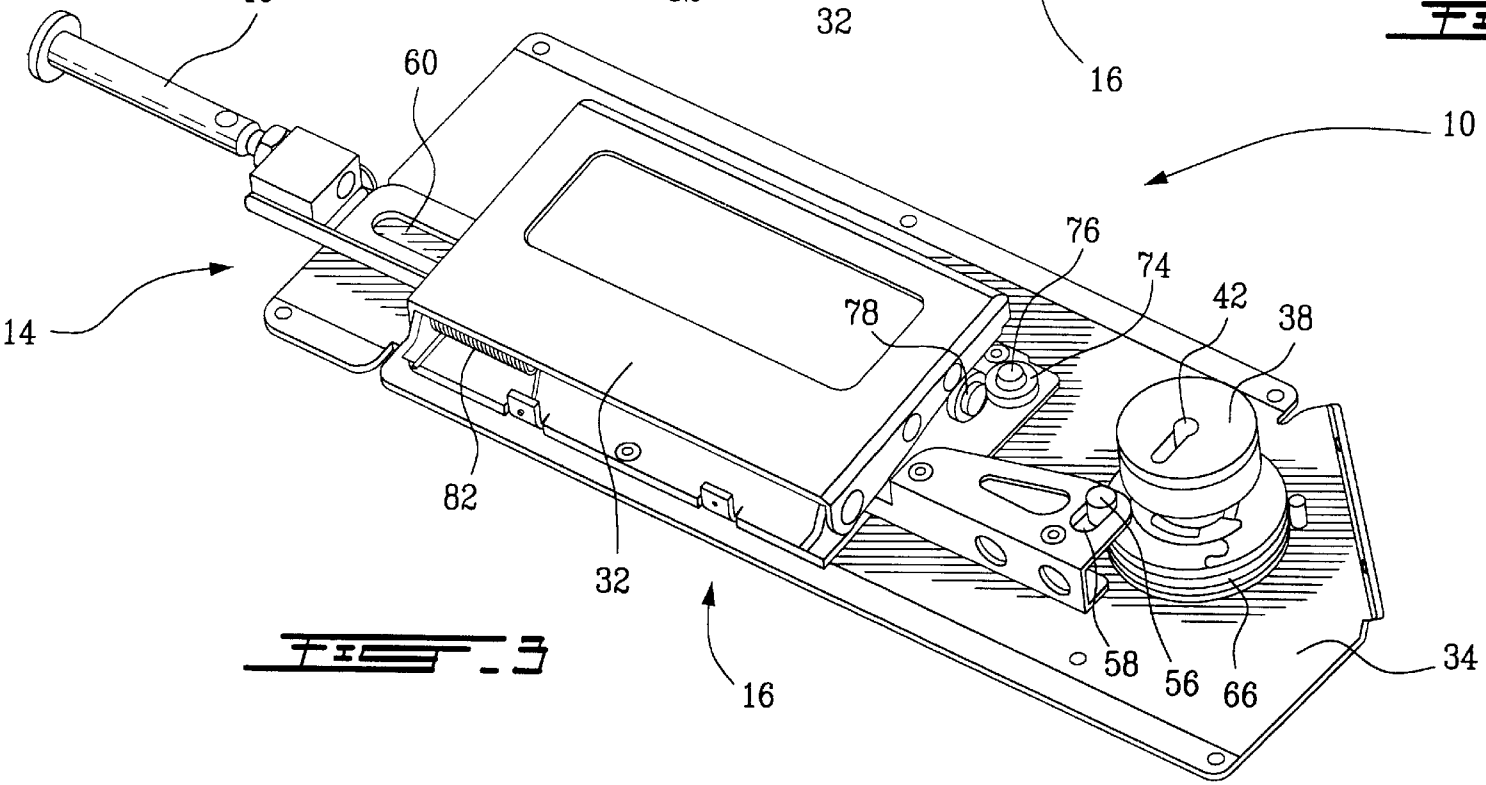
FIG. 3 is a perspective view of the main portion of the mechanism illustrated in FIG. 2.

As seen in FIGS. 1 and 3, an axially extending pin 56, secured to the drum 38, is engaged in a slot 58 defined at an inner end of the latch bolt 40 and extending perpendicularly relative thereto. The rotation of the drum 38 will thereby cause the latch bolt 40 to slide linearly relative to the casing 24. A longitudinal slot 60 is defined along a portion of the length of the bolt 40 for receiving a fixed guide pin 62 projecting at right angle from the mounting plate 34.

A bolt head 64 is provided at the outer end of the bolt 40 to physically interfere and prevent the opening of the sliding door when the bolt 40 is displaced to the extended position thereof. The bolt head 64 is adapted, when the bolt 40 is extended, to extend across the mouth of a door receiving pocket (not shown) in which the door is received when displaced to its open position.

Limit switches (not shown) are provided to detect the position of the bolt 40 in order to cut power to the door operator 12 when the bolt 40 is displaced to its extended position, thereby disabling the door operator 12 to prevent powered movement of the door in addition to the physical interfering action provided by the bolt head 64.

As seen in FIGS. 1 to 4, the emergency release door mechanism 16 includes a driven pulley 66 which is rotatably mounted about the key drum 38. The pulley 66 is drivingly connected to the emergency release handle 32 by means of a cable 68 secured at one end thereof to the periphery of the pulley at 70 and at the opposed end thereof to the emergency release handle 38. The cable 68 extends over a portion of the pulley 66 in a circumferentially extending groove 72 defined therein and then over a guide pulley 74 mounted about a pin 76 extending at right angle from the mounting plate 34 in parallel to the key drum 38. The cable 68 extends from the guide pulley 74 to a second guide pulley 78 mounted for rotation about an axis perpendicular to the pin 76 and the drum 38. The cable 68 then extends to the release handle 32 which is, in turn, mounted for pivotal movement about a pivot pin 80 extending in parallel to the plane of the mounting plate 34 and the rotation axis of the second guide pulley 78. A spring 82 (see FIG. 2) is disposed about the pivot pin 80 to normally bias the handle 32 towards the mounting plate 34 in an idle position thereof.

Figure 11:
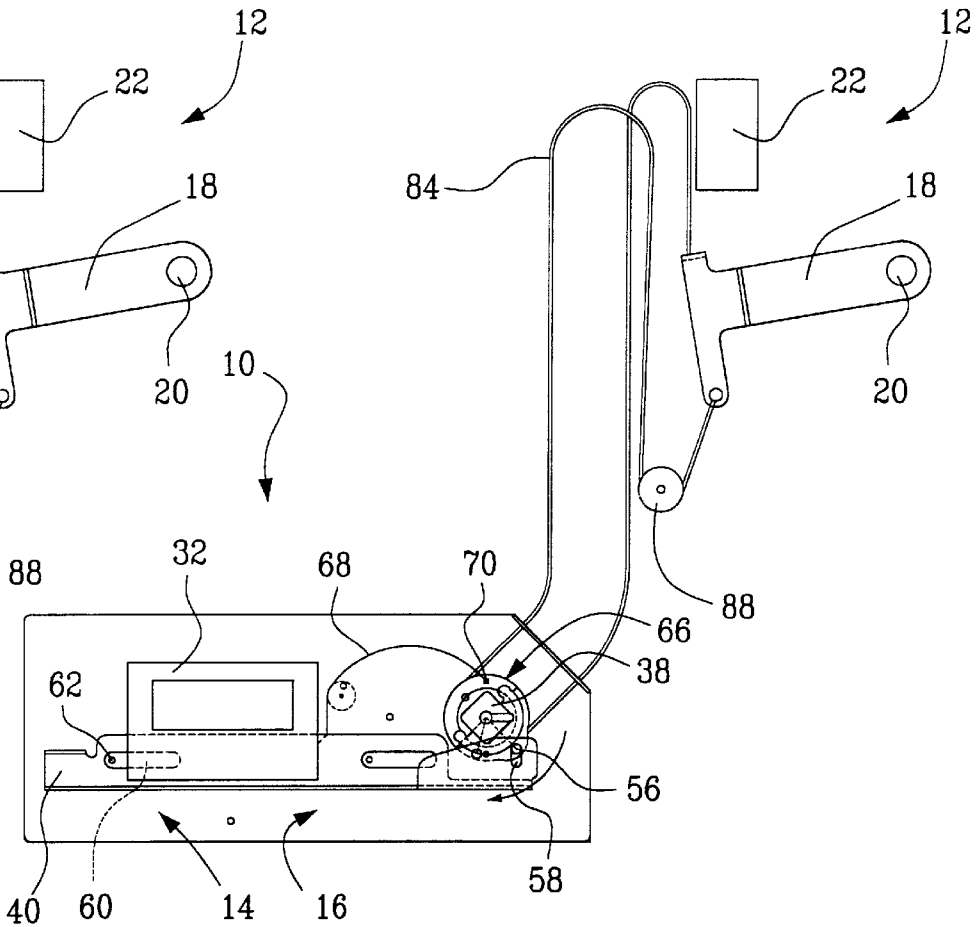

In the event that the handle 32 is pulled away from the mounting plate 34, the cable 68 will impart a tangential force on the pulley 66, thereby causing the same to rotate in a counterclockwise direction. The motion imparted to the pulley 66 is transmitted to the door operator 12 via a cable 84 extending in a closed loop over the pulley 66 in a second circumferentially extending groove 86 defined therein and over another pulley 88 mounted on an idle pin 90 located in the vicinity of the arm 18 and the electromagnetic unit 22 of the door operator 12. As seen in FIG. 1, the arm 18 is clipped at a distal end thereof to the cable 84 and, thus, movement of the cable 84 will be transmitted to the arm 18 and vice versa. Therefore, when the electromagnetic unit 22 is operated to pivot the arm 18 away therefrom in order to open the door, a motion is transmitted to the pulley 66, thereby creating a slack in the cable 68 between the handle 32 and the pulley 66, as seen in FIG. 11. Therefore, the handle 32 will remain inert.

In the event that the door is closed and that someone pulls the emergency release handle 32, the pulley 66 will rotate in a counterclockwise direction to cause the cable 84 to pull the arm 18 away from the electromagnetic unit 22, thereby releasing the door from the door operator 12 and allowing manual opening of the door.

Figure 4:
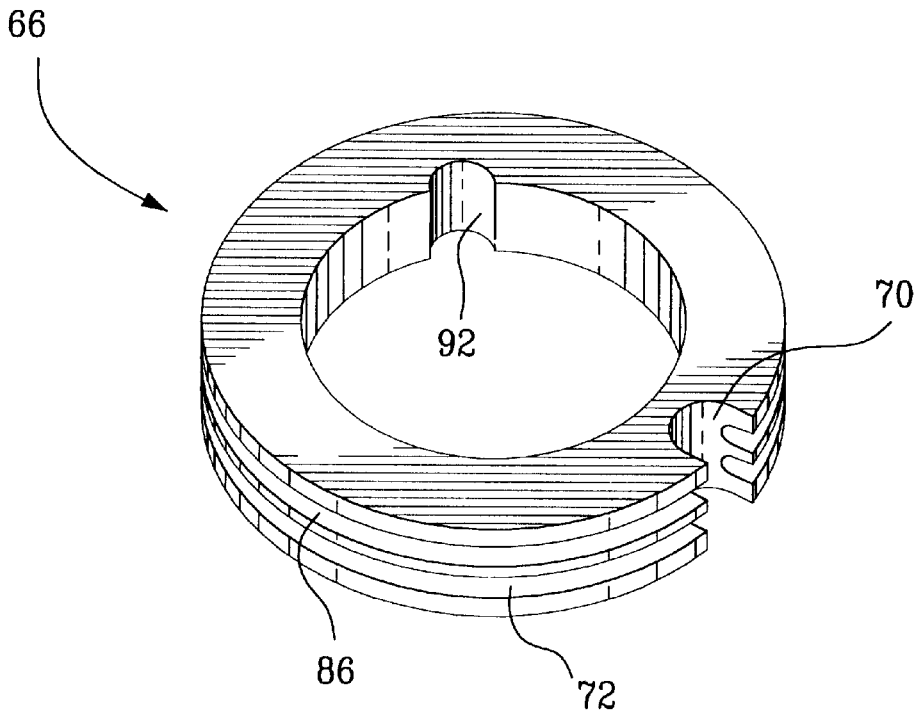
FIG. 4 is a perspective view of a pulley forming part of the mechanism illustrated in FIGS. 1 to 3.
Figure 5:
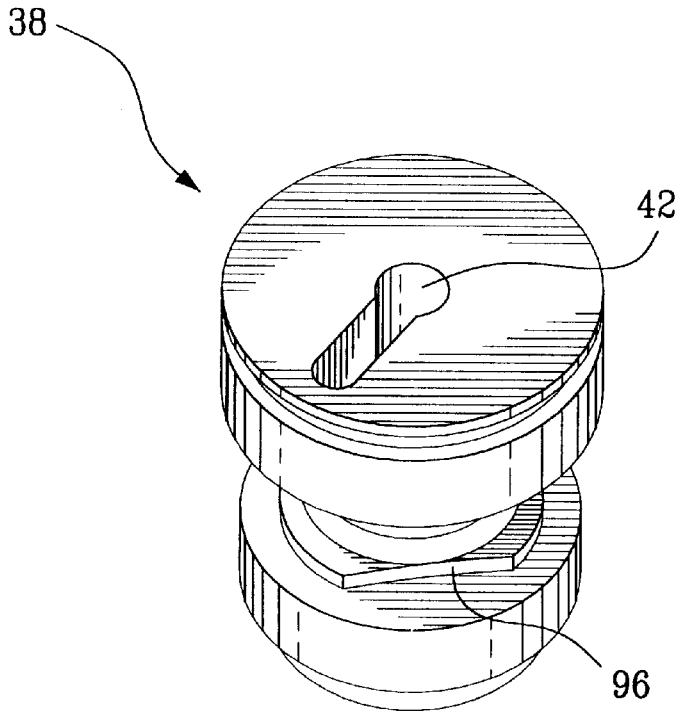
FIG. 5 is a perspective view of a key drum of a lock forming part of the lock and emergency release system of FIG. 1.

The emergency release door mechanism 16 further includes a clutch mechanism for selectively connecting and disconnecting the pulley 66 and the drum 38. More specifically, as seen in FIG. 4, the pulley 66 has a semi-cylindrical recess 92 defined in an internal circumferential surface thereof for receiving a torque transferring member provided in the form of a cylinder 94 (see FIGS. 12 to 15). The cylinder 94 is trapped in the recess 92 between the pulley 66 and the drum 38 and is constrained to move in a cutout portion 96 defined along about a quarter of the circumference of the drum 38, as seen in FIGS. 12 to 15.

Figure 8:
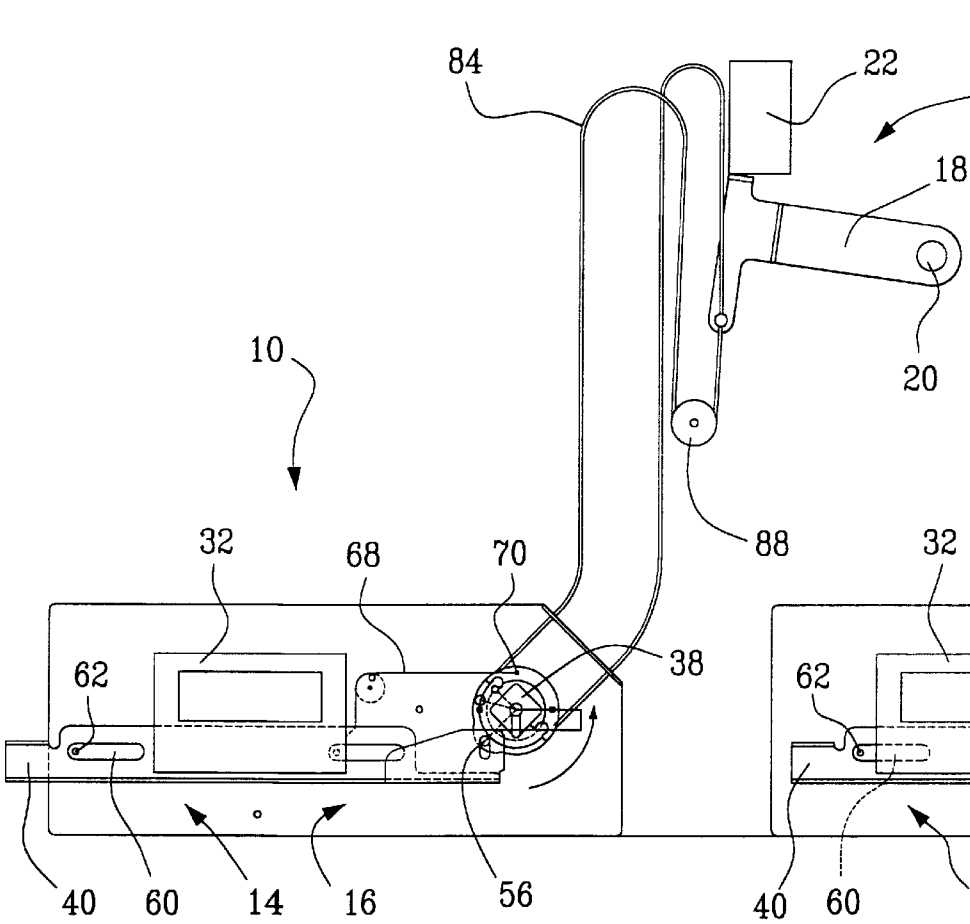
Figure 10:
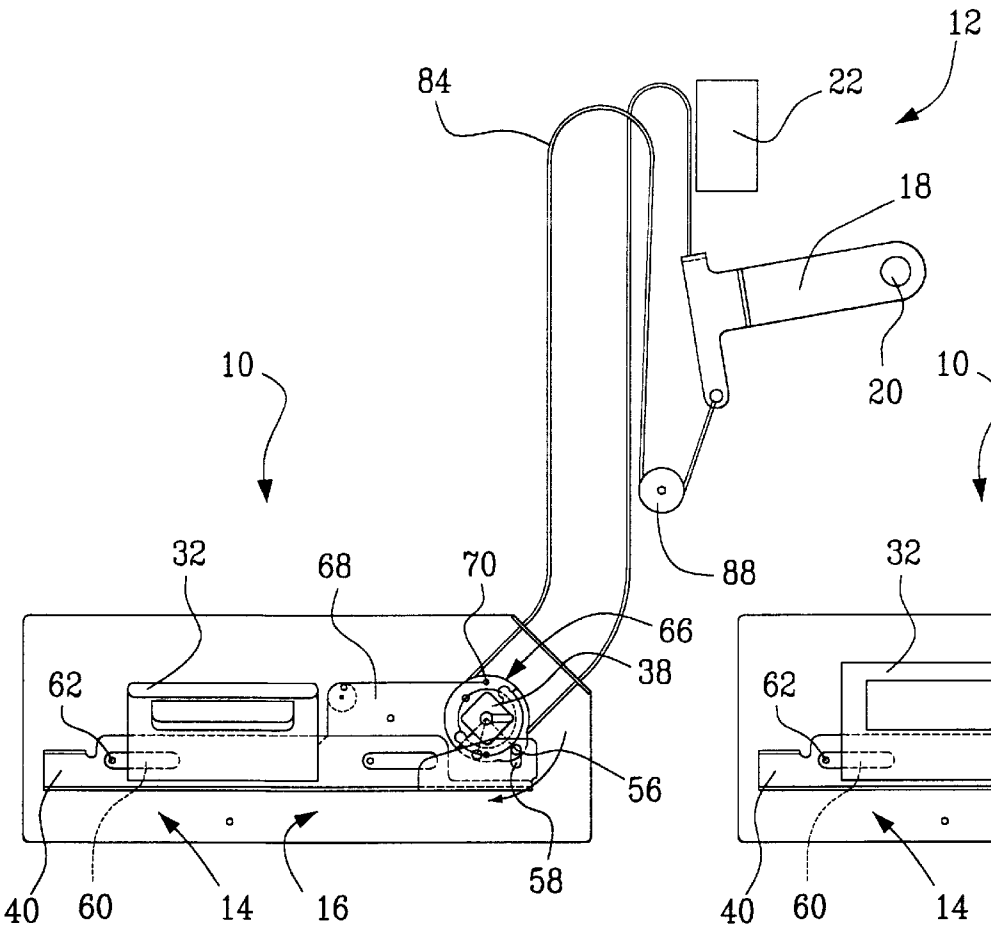
Figure 12:
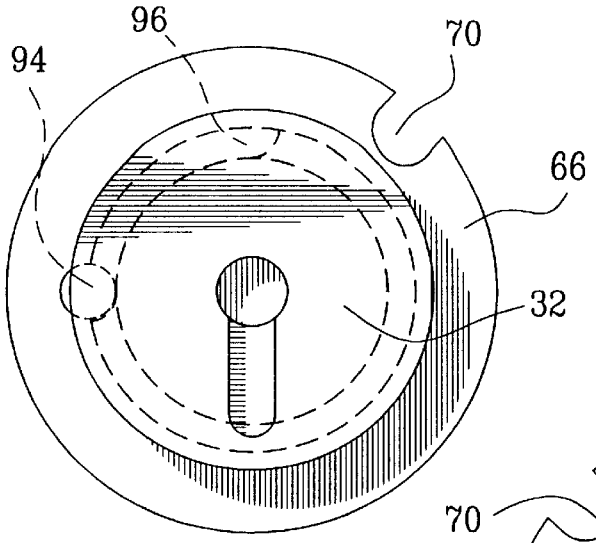
FIGS. 12 and 13 are enlarged front elevational views of the key drum and the main pulley of the system, illustrating how the drum key is rotated from a locked position to an unlocked position by the pulley when an emergency release handle is pulled.
Figure 13:
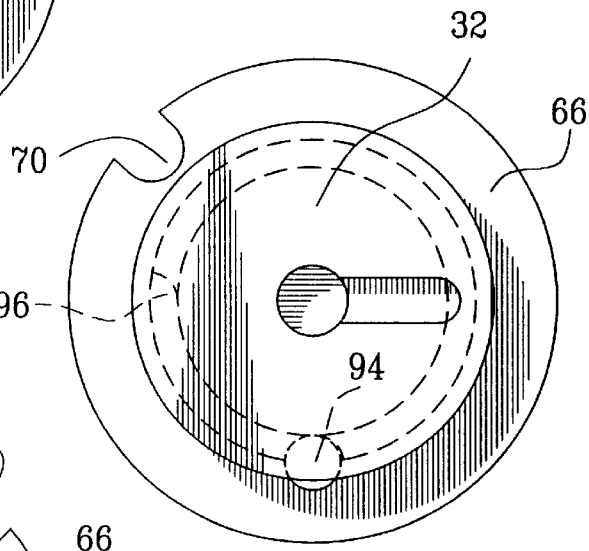

By turning the drum 38 in a clockwise direction to a locked position so as to displace the bolt 40 to the extended position thereof, as illustrated in FIG. 8, the cylinder 94 is placed in abutment with one end of the cutout portion 96 (see FIG. 12) so that subsequent rotation of the pulley 66 in a counterclockwise direction will cause the drum 38 to rotate therewith. Accordingly, if the emergency handle 32 is subsequently pulled with a view of opening the door, the cable 68 will cause the pulley 66 to rotate in a counterclockwise direction, thereby causing the drum 38 to rotate to an unlocked position thereof to produce the retraction of the bolt 40, as illustrated in FIGS. 10 and 13. Simultaneously, the rotation of the pulley 66 will cause the endless cable 84 to act on the arm 18 to pivot the same away from the electromagnetic unit 22, thereby releasing the door from the door operator 12.

Figure 9:
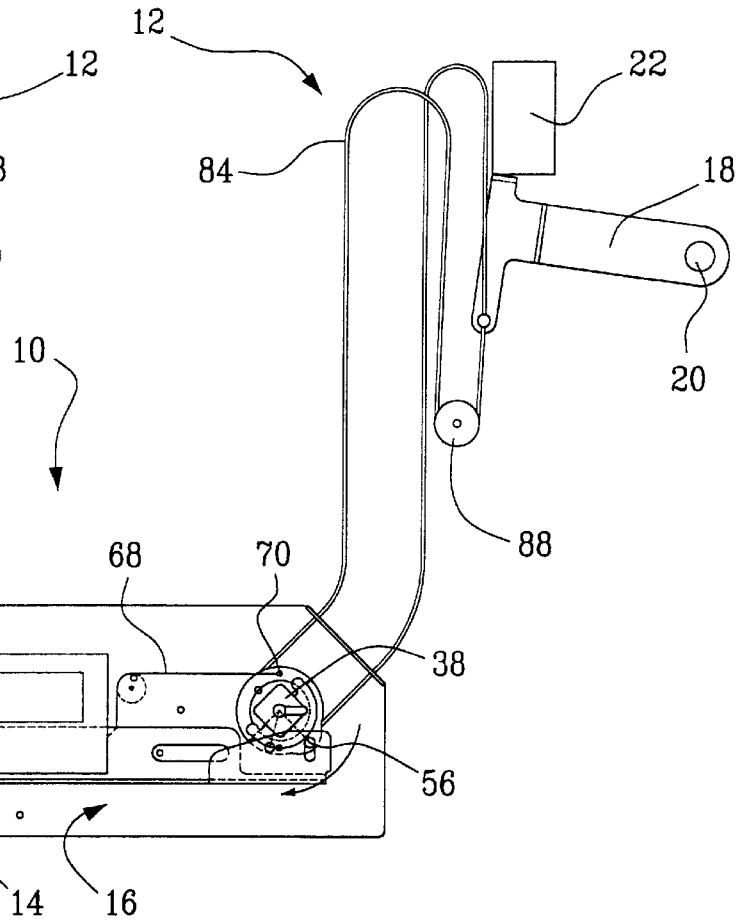
FIGS. 8 to 11 are schematic front elevational views of the system of FIG. 1, illustrating the operation of the system.
Figure 14:
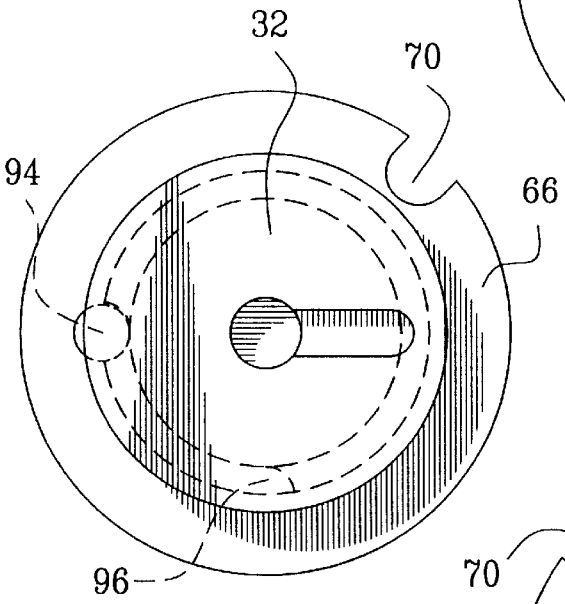
FIGS. 14 and 15 are enlarged front elevational views of the key drum and the main pulley of the system illustrating how the pulley is disconnected from the key drum when the same is in an unlocked position thereof.
Figure 15:
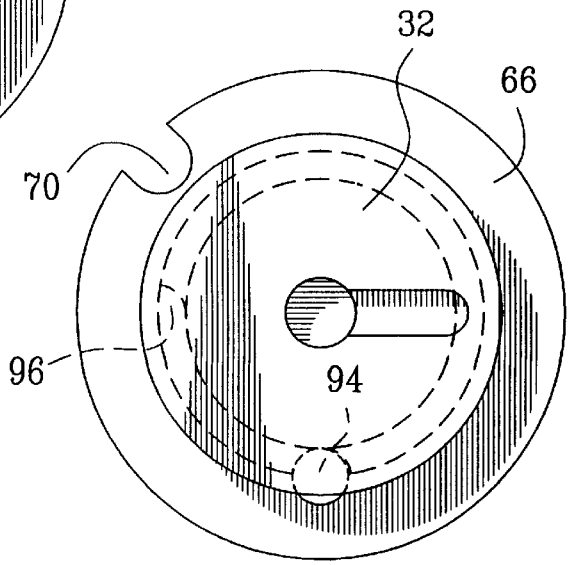

Thereafter, if the door operator 12 is activated back to close the door, the arm 18 will pivot towards the electromagnetic unit 22, as seen in FIG. 9, thereby causing the pulley 66 to rotate in a clockwise direction without driving the drum 38, as seen in FIG. 14. While the drum 38 is in its unlocked position, the door operator 12 can be activated to open and close the door and the pulley 66 will rotate without driving the drum 38 because the cylinder 94 in displaced within the limits of the cutout portion 96. If the emergency handle 32 is pulled while the door is opened (i.e. when there is a slack in the cable 68, between the handle 32 and the pulley 66, as seen in FIG. 11) the cable 68 will only become stretched. However, when the door is closed, the cable 68 is stretched and if a person pulls on the handle 32, the pulley 66 will rotate in a counterclockwise direction about the drum 38 from the position illustrated in FIG. 14 to the position illustrated in FIG. 15, thereby causing the cable 84, which runs in a closed loop, to pivot the arm 18 away from the electromagnetic unit 22 to a position wherein the door is released from the door operator 12.

As seen in FIG. 1, an outer emergency handle 98 can be provided on an opposite side of the door for allowing someone to release the door from the door operator 12 and unlock the lock 14 from outside of the enclosure closed by the door. The outer emergency handle 98 is directly connected to the arm 18 via a cable 100 and is thus effective for driving the pulley 66 via the cable 84, according to the above description.

What is claimed is:

1. A lock and emergency release system for a sliding door normally power operated by a door operator, the system comprising a lock displaceable between an idle position to a functional position in which the door operator is prevented from opening the door, at least one emergency release means manually operable for displacing said lock to said idle position thereof and releasing the door from said door operator, thereby allowing the door to be manually opened, said system further includes a driven member for operatively connecting said emergency release means to the door operator, wherein said lock includes a key drum and a latch bolt displaceable by said key drum, said key drum being rotatable between unlocked and locked positions for respectively retracting and extending said latch bolt, said driven member being rotatably mounted about said key drum, and wherein a torque transferring member is provided between said driven member and said key drum for allowing said driven member to rotate said key drum from said locked position to said unlocked position, while allowing said driven member to rotate independently of said key drum between limit positions thereof when said key drum is in said unlocked position.

2. A lock and emergency release system as defined in claim 1, wherein said driven member is operatively connected to said lock when the same is in said functional position thereof, while being free to move with respect thereto when said lock is in said idle position.

3. A lock and emergency release system as defined in claim 2, wherein said torque transferring member is secured to said driven member and is constrained to move in a cutout portion defined along a portion of a circumference of said key drum.

4. A lock and emergency release system as defined in claim 2, wherein said driven member is provided in the form of a pulley mounted about said key drum to transmit a force to the door operator via a cable extending over the pulley.

5. A lock and emergency release system as defined in claim 4, wherein said cable extends in a closed loop over said pulley and another pulley disposed at a remote location relative to said emergency release means, wherein said emergency release means is a handle and wherein said cable is adapted to be connected to the door operator at a location between said pulleys.

6. A lock and emergency release system as defined in claim 5, wherein said emergency release handle is connected to said pulley via a second cable.

7. A lock and emergency release system as defined in claim 6, wherein a second release handle is connected to said first cable at said location thereon.

8. A lock and emergency release system as defined in claim 1, wherein said lock is capable, when displaced to a functional position thereof, to physically interfere with the opening of the door and disable the door operator to prevent powered movement of the door against said lock.

* * * * *